252-99 AU 165 EX
6/22/76 XR 3,965,015

United States Patent [19]
Bauman

[11] 3,965,015
[45] June 22, 1976

[54] BLEACH-RESISTANT FABRIC SOFTENER

[75] Inventor: Robert Andrew Bauman, New Brunswick, N.J.

[73] Assignee: Colgate-Palmolive Company, New York, N.Y.

[22] Filed: Sept. 19, 1974

[21] Appl. No.: 507,508

Related U.S. Application Data

[63] Continuation of Ser. No. 277,097, Aug. 1, 1972, abandoned.

[52] U.S. Cl. ..... 252/8.8; 252/8.75; 252/99; 252/102; 252/525; 252/526; 252/544; 252/545; 260/553 R

[51] Int. Cl.[2] ..... C11D 1/50; D06M 13/40

[58] Field of Search ..... 252/8.6, 8.75, 8.8, 252/102, 544, 545, 525; 260/553 R

[56] References Cited

UNITED STATES PATENTS

| | | | |
|---|---|---|---|
| 2,304,113 | 12/1942 | Morgan et al. | 428/272 |
| 2,734,830 | 2/1956 | Hagge et al. | 117/47 |
| 2,929,788 | 3/1960 | Freese et al. | 252/8.75 |
| 3,454,494 | 7/1960 | Clark et al. | 252/8.8 |
| 3,630,894 | 12/1971 | Lazaridis et al. | 252/8.6 |

OTHER PUBLICATIONS

Stoutland et al., Article in Journal of Organic Chemistry, vol. 24, June 1959, pp. 818–820.

*Primary Examiner*—Herbert B. Guynn
*Attorney, Agent, or Firm*—John J. Tomaszewski; Murray M. Grill; Herbert S. Sylvester

[57] ABSTRACT

A bleach-stable fabric detergent and/or softening composition comprising effective amounts of a softening agent selected from the group consisting of a urea, diurea, thiourea, dithiourea and mixtures thereof represented by the formulae:

1. $RNHCXNH(CH_2)_n NH_2$, and
2. $RNHCXNH(CH_2)_nNHCXNHR$, wherein R is an alkyl group containing 2–18 carbons or an aryl group, X is oxygen or sulfur, and $n$ is 2–12, said softener being compatible with surfactants and other ingredients normally found in detergent formulations.

17 Claims, No Drawings

BLEACH-RESISTANT FABRIC SOFTENER

This is a continuation of application Ser. No. 277,097, filed Aug. 1, 1972, now abandoned.

The present invention relates to bleach stable cleaning and/or softening compositions which impart to textiles laundered therewith an outstanding and superior degree of softness containing a substituted urea, diurea, thiourea, dithiourea, or mixture thereof as the softening agent which is compatible with anionic, cationic, non-ionic, ampholytic and zwitterionic detergents.

The employment of various compounds and compositions, and particularly cationic quaternary ammonium compounds as softeners is very well known and conventional in the art. It is also well known to employ these materials for their softening effect during a laundering operation, and particularly in the rinse cycle of the laundering process. This technique has been necessitated by the fact that such cationic compounds as heretofore used are not compatible with the major type of detergent presently used in the washing cycle of the laundering operation.

By far the predominating type of detergent used in home laundering, as well as in commercial and industrial laundering processes, is of the anionic type and, more particularly, is of the alkali metal higher alkyl benzene sulphonate type. The use of a cationic substance in conjunction with anionic detergent materials results in a precipitate which is completely ineffective as a fabric softener. This manifestation of incompatibility is also undesirable because it requires more detergent in order to accomplish the necessary and desirable degree of washing efficacy. As a consequence of these difficulties, it is generally necessary and conventional to add the presently available cationic softeners to the clothes in the absence of any anionic detergent, and obviously where this is done during washing, it must be accomplished during the rinsing cycle.

Still another known disadvantage of the cationic softeners lies in their tendency to yellow or discolor fabrics when the latter are treated with such compounds, whether in a laundering operation at any stage, or, again, as a general treatment for textiles to soften them.

It is therefore an object of this invention to provide compositions capable of simultaneously cleaning and softening fabrics.

It is another object of this invention to provide softening agents which are bleach-stable and compatible with anionic, cationic, non-ionic, ampholytic and zwitterionic detergents.

It is still another further object of this invention to provide a detergent composition in any suitable physical form, from liquid to solid state, including gels, pastes, powders, tablets, etc., which is outstanding in both cleaning and softening textiles laundered therewith, and which does not produce a noticeable yellowing of the textile material.

Still another object of this invention lies in the provision of detergent compositions which are characterized as "built" detergents, and which are not only outstanding in their laundering performance, but are also superior and unique in producing a non-yellowing, soft finish on laundered goods.

Still another object of this invention lies in providing processes for making and using the softening and detergent composition of this invention, and particularly for using such compositions in a laundering process.

It has now been found that compositions containing the aforedefined urea, diurea, thiourea, dithiourea and mixtures thereof are effective in softening textiles without yellowing, said fabric softener being compatible with organic surfactants, builder salts, bleaches, brighteners, and other ingredients normally found in detergent compositions.

This compatibility has permitted the use of aforesaid fabric softeners at any stage during laundering, including the wash cycle. Consequently, both softening compositions and detergent compositions containing said softening agents are contemplated by instant invention. Said detergent compositions provide simultaneous softening and cleaning of fabrics in a single operation.

The fabric softening and/or detergent composition of instant invention comprises an effective amount of a softening agent selected from the group consisting of a urea, diurea, thiourea, dithiourea and mixtures thereof, represented by the formulae:

1. $RNHCXNH(CH_2)_nNH_2$, and/or
2. $RNHCXNH(CH_2)_nNHCXNHR$, wherein R is an alkyl group containing 2–18 carbons or an aryl group, X is oxygen or sulfur, and $n$ is 2–12.

The urea and thiourea derivative used in this invention are generally known and may be prepared by reacting an alkyl or aryl isocyanate with an alkane diamine, as described by Stoutland, J. Org. Chem., 24, 818–820 (1959).

The reaction proceeds in accordance with the following equations:

1. $RNCX + NH_2(CH_2)_nNH_2 \rightarrow RNHCXNH(CH_2)_nNH_2$ +/or $RNHCXNH(CH_2)_nNH_2CXNHR$, depending on the molar quantities of the reactants as well as on the relative reactivities of the reactants and on other conditions occuring during the reaction. By using 1 mole of the isocyanate to 2 moles of the diamine, the mono-derivative is the major reaction product. Similarly, the utilization of equimolar amounts of reactants or 2 moles of isocyanate per mole of diamine normally yields a major amount of the di-derivative. However, the conditions during the reaction, such as basicity, varying degrees of reactivities of the reactants and the speed of the reaction is also determinative of the ratio of the formation of the mono- and/or the di-urea or thiourea. The mono- and di-derivatives can be separated by extracting with suitable solvents such as acetonitrile, chloroform, aqueous alcohol, etc. However, separation is unnecessary since a mixture of the mono- and di-derivatives has also been found to be effective as a fabric softening agent.

The organic isocyanate reactant may be octadecyl isocyanate, hexadecyl isocyanate, dodecyl isocyanate, n-butyl isocyanate, phenyl isocyanate, ethyl isocyanate, propyl isocyanate, hexyl isocyanate, pentyl isocyanate, heptyl isocyanate, octyl isocyanate, nonyl isocyanate, decyl isocyanate, undecyl isocyanate, tridecyl isocyanate, tetradecyl isocyanate, etc., and the corresponding isothiocyanates.

Suitable diamines include diaminoethane, diaminopropane, diaminododecane, diaminodecane, diaminobutane, diaminohexane, diaminopentane, diaminoisopropane, diaminooctane, diaminoheptane, diaminononane, etc.

The mono- and di-urea, and the mono- and di-thiourea compounds of instant invention are readily dispersible in an aqueous medium, either in the presence or absence of surfactants and other ingredients normally found in detergent formulations.

Specific examples of softeners in accordance with instant invention include:

1. 1-Dodecyl-3-(3' 'aminopropyl) urea and corresponding diurea.
2. 1-n-Butyl-3-(10'-aminodecyl) urea and corresponding diurea.
3. $C_{18}H_{37}NHCONHCH(CH_3)CH_2NH_2$ and $C_{18}H_{37}NHCONHCH(CH_3)CH_2NH_2CONHC_{18}H_{37}$.
4. $C_{18}H_{37}NHCONH(CH_2)_3NH_2$ and $C_{18}H_{37}NHCONH(CH_2)_3NH_2CONHC_{18}H_{37}$.
5. $(C_{16}H_{33}—C_{18}H_{37})NHCONH(CH_2)_2NH_2$ and $(C_{16}H_{33}—C_{18}H_{37})NHCONH(CH_2)_2NH_2CONH(C_{16}H_{33}—C_{18}H_{37})$.
6. $C_4H_9NHCONH(CH_2)_{12}NH_2$ and $C_4H_9NHCONH(CH_2)_{12}NH_2CONHC_4H_9$.
7. $C_6H_5NHCONH(CH_2)_8NH_2$ and $C_6H_5NHCONH(CH_2)_8NH_2CONHC_6H_5$.
8. $C_2H_5NHCSNH(CH_2)_{12}NH_2$ and $C_2H_5NHCSNH(CH_2)_{12}NH_2CSNHC_2H_5$.
9. $C_{18}H_{37}NHCONH(CH_2)_6NH_2$ and $C_{18}H_{37}NHCONH(CH_2)_6NH_2CONH(C_{18}H_{37})$.
10. $C_{18}H_{37}NHCONH(CH_2)_8NH_2$ and $C_{18}H_{37}NHCONH(CH_2)_8NH_2CONH(C_{18}H_{37})$.
11. $C_{18}H_{37}NHCONH(CH_2)_{10}NH_2$ and $C_{18}H_{37}NHCONH(CH_2)_{10}NH_2CONH(C_{18}H_{37})$.
12. 1-Butyl-3-(3'aminopropyl) urea and corresponding diurea, etc.

The following examples are merely illustrative of the preparation of the urea and thiourea derivatives of this invention and are not to be construed as limited thereto.

EXAMPLE 1

Preparation of 1-Dodecyl-3-(3'-aminopropyl) urea

In a 500 ml flask protected by a soda lime tube is placed 8 g (0.108 mole) of 1,3-diaminopropane in 150 ml ether. The solution is stirred in an ice bath for 30 minutes during the slow addition of a solution of 11.1 g (0.0525 mole) dodecyl isocyanate in 50 ml ether. After standing 15 minutes, the white solid precipitate was separated by filtration, washed well with ether, and dried. The 15.2 g solid obtained is crystallized from a mixture of 1 100 ml alcohol and 600 ml water. From the 10.7 g which dissolved, there is obtained 9.2 g recrystallized product. An analytical sample recrystallized from acetonitrile melted at 97°–98°C.

| Analysis for $C_{16}H_{35}N_3O$: | C | H | N |
|---|---|---|---|
| Calculated: | 67.32 | 12.36 | 14.72 |
| Found: | 67.75 | 12.64 | 14.68 |

EXAMPLE 2

Preparation of 1-n-Butyl-3-(10'-aminodecyl) urea

In a 500 ml flask protected with a soda lime tube is placed 10 g (0.058 mole) 1,10-diamino decane and 150 ml ether. A solution of 2.5 g (0.025 mole)n-butyl isocyanate in 25 ml ether is added and the reaction mixture stirred 1 hour. The precipitate is filtered, washed with ether, and dried to 15 g weight. Recrystallization from a mixture of 200 ml alcohol and 100 ml water gives 5.6 g white solids. An analytical sample recrystallized from acetonitrile melts at 83°–84.5°C.

| Analysis for $C_{15}H_{33}N_3O$: | C | H | N |
|---|---|---|---|
| Calculated: | 66.37 | 12.25 | 15.48 |
| Found: | 66.55 | 12.72 | 15.62 |

EXAMPLE 3

Preparation of 1-n-Butyl-3-(aminododecyl) urea 22 grams (.110 mole) of 1,12-diaminododecane in 300 cc ether was reacted with 5.0 g (0.0505 mole) Butyl isocyanate, as in Example 2. The precipitate is filtered, washed, and recrystallized from 250 cc alcohol containing 50 cc water. Recovered 7.8 grams. Chilled mother liquor, thereby recovering a second batch of crystals which combined with the first precipitate to give a total of 12.1 grams having a melting point of 97°C.

EXAMPLE 4

Preparation of 1-ethyl-3-(aminododecyl) thiourea 22 grams (.110 mole) of 1,12-diaminododecane in 300 cc ether was reacted via dropwise addition with 5 grams (0.058 mole) ethyl isothiocyanate. The precipitate was filtered, washed with ether and recrystallized from alcohol yielding 6 grams of the thiourea derivative.

EXAMPLE 5

Preparation of 1-phenyl-3-(aminooctyl) urea 22 grams (0.139 moles) 1,8 diaminooctane in 300 cc ether was reacted with 7.0 gms (.059 mole) phenylisocyanate. The precipitate was filtered and washed with ether, yielding 10.9 gms. Recrystallized from dimethylformamide and recovered 7.8 gms having a melting point of 200°–217°C.

EXAMPLE 6

Preparation of 1-octadecyl-3-(aminoethyl) urea 20 grams (0.33 moles) ethylene diamine in 200 cc ether was reacted with 5.0 gms (.0168 mole) octadecylisocyanate in 25 cc ether. A white precipitate forms which is stirred for 2 hours, filtered and washed with ether and recrystallized from 2 propane, melting point 108°–127°C.

EXAMPLE 7

Preparation of mixture of 30 percent 1-octadecyl-3-(aminopropyl) urea and 40 percent diurea 20 grams (0.27 mole) of 1,3 diaminopropane in 250 cc ether was reacted with 15 gms (.051 mole) octadecyl isocyanate. The precipitate was filtered, washed with ether, and dried in vacuum oven, melting point 106°–134°C. Extracted with acetonitrile at boiling point. Insoluble matter has a melting point of 142°–143°C. The soluble matter was crystallized and has a melting point of 89°–93°C.

EXAMPLE 8

Preparation of 1-octadecyl-3-(aminohexyl) urea 29 grams 1,6-hexanediamine (0.25 mole) was reacted with 20 gms (0.068 mole) octadecyl isocyanate as in Example 2. Yield: 25.5 gms, melting point 123°–168°C.

EXAMPLE 9

Preparation of 1-octadecyl-3-(aminooctyl) urea 36 grams (.25 mole) of 1,8 diaminooctane was reacted with 20 gms (0.068 mole) octadecyl isocyanate as in Example 2. Yield: 26.6 gms, melting point 120°–145°–156°C.

EXAMPLE 10

Preparation of 1-octadecyl-3-(aminopropyl) urea 19 grams (.25 mole) of 1,3 diaminopropane was reacted with 20 gms octadecyl isocyanate as in Example 2. Yield: 22.2 gms., melting point 116°–140°–150°C.

EXAMPLE 11

Preparation of a mixture of 50 percent 1-octadecyl-3-(aminodecyl) urea and 50 percent diurea 10 grams (0.06 mole) 1,10 diaminodecane in 200 cc ether was reacted with 5 gms octadecyl isocyanate as in Example 2. Yield: 7.4 gms, melting point 115°–148°C. Extracted with boiling acetonitrile, filtered and dried. Insoluble material has a melting point of 135°–162°C and the soluble material has a melting point of 105°–110°–125°C.

EXAMPLE 12

Preparation of 1-octadecyl-3-(amino dodecyl) urea 12 grams 1,12 diaminododecane was reacted with 5 gms octadecyl isocyanate as in Example 2. Yield: 13.8 gms., melting point 105°–159°C.

EXAMPLE 13

Preparation of mixture of 50 percent 1-octadecyl-3-(aminoethyl) urea and 30 percent diurea 15 grams ethylene diamine in 200 cc ether was slowly (over a period of 2 hours) reacted with 20 gms octadecyl isocyanate at room temperature and refluxed for 30 minutes. The reaction mixture was filtered, washed with ether, and dried in vacuum oven. Yield: 27 grams, melting point 100°–150°–153°C. Extracted with acetonitrile on a steam bath and recrystallized. The insoluble material has a melting point of 130°–180°C; melting point of soluble material is 104°–106°C.

EXAMPLE 14

Preparation of 1-Butyl-3-(3′ aminopropyl) urea 30 grams 1,3 diaminopropane in 30 mls ether was slowly (1 hour) reacted with 10 gms butyl isocyanate and refluxed for one-half hour. The precipitate was filtered and washed with ether and dried in vacuum oven, melting point 201°–202°C.

EXAMPLE 15

Preparation of 1-Butyl-3-)3′ aminopropyl) diurea

Reacted 5 grams of product of Example 14 with 6.0 gms butyl isocyanate in the presence of 30 cc hexamethyl phosphoramide solvent. Heated the reaction mixture on steam bath for 1 hour, cooled to room temperature, and poured into ether. Recrystallized the precipitate from 50 cc alcohol. Yield: 4.2 gms, melting point 196°–198°C.

The quantity of isocyanate-diamine or isothiocyanate-diamine reaction product may vary considerably in the compositions of the invention. By isocyanate-diamine reaction product is meant the monoureas, diureas, and mixtures thereof. This is also applicable to the isothlocyanate reaction product. Generally, said product should comprise from about 1 percent to about 20 percent by weight of the formulation, with a preferred range being from 2 to 10 percent by weight.

The fabric softening composition of this invention may contain a bleaching agent or may be used simultaneously with a bleaching composition in the treatment of fabrics because of its excellent compatibility therewith. No degradation of either the bleaching agent (i.e., chloride) or the softening agent (urea, diurea, thiourea or dithiourea) occurred as evidenced by the following test: 1-Dodecyl-3-(3′ aminopropyl) urea plus detergent (LTBS) was aged at room temperature for 5 minutes and 15 minutes, respectively, in the presence of Clorox. No loss of available chlorine was detected by titrimetric analysis. Accordingly, instant softening and/or detergent composition may contain one or more bleaching agents capable of liberating hypochlorite chlorine and/or hypobromite bromine on contact with aqueous media. Particular examples of bleaching agents include the dry, particulate heterocyclic N-bromo and N-chloro imides such as trichlorocyanuric, tribromocyanuric acid, dibromo- and dichlorocyanuric acid, the salts thereof with water-solubilizing cations such as potassium and sodium, and mixtures thereof. Particular compounds found useful are potassium dichloro-isocyanurate and trichloroisocyanuric acids.

Other N-bromo and N-chloro imides may also be used, such as N-brominated and N-chlorinated succinimide, malonimide, phthalimide and naphthalimide. Other compounds include the hydantoins, such as 1,3-dibromo- and 1,3-dichloro-5, 5-dimethylhydantoin, N-monochloro-5, 5-dimethylhydantoin, methylene-bis (N-bromo-5, 5-dimethylhydantoin); 1,3-dibromo and 1,3-dichloro 5-isobutylhydantoin; 1,3-dichloro 5, methyl-5-ethylhydantoin; 1,3-dibromo and 1,3-dichloro-5,5-diisobutylhydantoin, 1,3-dibromo and 1,3-dichloro-5-methyl-5-n-amylhydantoin, and the like. Other useful hypohalite-liberating agents comprise tribromomelamine and trichloromelamine. Dry particulate, water-soluble anhydrous inorganic salts, are likewise suitable for use such as lithium hypochlorite and hypobromite. The hypohalite-liberating agent may, if desired, be provided in the form of a stable, solid complex or hydrate, such as sodium p-toluene-sulfo-bromamine-trihydrate, sodium benzene-sulfochloramine-dihydrate, calcium hypobromite tetrahydrate, calcium hypochlorite tetrahydrate, etc. Brominated and chlorinated trisodium phosphate formed by the reaction of the corresponding sodium hypohalite solution with trisodium phosphate (and water, as necessary) likewise comprise efficacious materials. The present invention contemplates as an additional embodiment the use of bleaching agents capable of liberating hypochlorite as well as hypobromite, such as, for example, the N-brominated, N'-chlorinated heterocyclic imides, as for example, the N-bromo, N'chloro-cyanuric acids and salts thereof, e.g., N-monobromo-N, N-dichloro-cyanuric acid, N-mono-bromo-N-monochlorocyanuric acid, sodium-N-monobromo-N-monochloro-cyanurate, potassium-N-monobromo-N-monochloro-cyanurate; and the N-brominated, N-chlorinated hydantoins, e.g., N-bromo-N-chloro-5, 5-dimethylhydantoin and N-bromo-N-chloro-5-ethyl-5-methyl hydantoin.

The hypohalite-liberating compound is employed in an amount of from 0.5 to 5 percent by weight of the composition, and preferably in an amount of from about 0.5 to 3 percent by weight thereof. In any event, the hypohalide material should preferably be employed in amounts sufficient to yield from about 0.5–3 percent available chlorine, bromine, etc. in order to assure optimum results.

The detergent compositions of this invention may contain any of the conventional organic surface-active, detersive agents selected from the general classes of anionic, non-ionic, cationic, ampholytic and zwitterionic agents, in addition to the isocyanate-or isothiocyanate-diamine reaction product.

The surface-active detergent compound of the compositions of this invention may, as noted above, be selected from any one of the major classes of detergents, which include the anionic, cationic, non-ionic, ampholytic and zwitterionic types.

The anionic surface-active agents include those surface-active or detergent compounds which contain an organic hydrophobic group and an anionic solubilizing group. Typical examples of anionic solubilizing groups are sulfonate, sulfate, carboxylate, phosphonate and phosphate. Examples of suitable anionic detergents which fall within the scope of the invention include the soaps, such as the water-soluble salts of higher fatty acids or resin acids, such as may be derived from fats, oils and waxes of animal, vegetable or marine origin, e.g., the sodium soaps of tallow, grease, coconut oil, tall oil and mixtures thereof; and the sulfates and sulfonated synthetic detergents, particularly those having at least 8, and about 8 to 30, and preferably about 12 to 22, carbon atoms in the molecular structure.

As examples of suitable synthetic anionic detergents, there may be cited the higher alkyl mononuclear aromatic sulfonates such as the higher alkyl benzene sulfonates containing from 10 to 16 carbon atoms in the alkyl group in a straight or branched chain, e.g., the sodium salts of higher alkyl benzene sulfonates or of the higher alkyl toluene, xylene and phenol sulfonates; alkyl naphthalene sulfonate, ammonium diamyl naphthalene sulfonate, and sodium dinonyl naphthalene sulfonate. Mixed long chain alkyls derived from coconut oil fatty acids and tallow fatty acids can also be used along with cracked paraffin wax olefins and polymers of lower mono-olefins. In one preferred type of composition there is used a linear alkyl benzene sulfonate having a high content of 3- (or higher) phenyl isomers, and a correspondingly low content (well below 50%) of 2- (or lower) phenyl isomers; in other terminology, the benzene ring is preferably attached in large part at the 3 or higher (e.g., 4, 5, 6 or 7) position of the alkyl group and the content of isomers in which the benzene ring is attached at the 2 or 1 position is correspondingly low. Particularly preferred materials are set forth in U.S. Pat. No. 3,320,174, May 16th, 1967, of J. Rubinfeld.

Other anionic detergents are the olefin sulfonates, including long chain alkene sulfonates, long chain hydroxyalkane sulfonates, or mixtures of alkene-sulfonates and hydroxyalkanesulfonates. These olefin sulfonate detergents may be prepared, in known manner, by the reaction of $SO_3$ with long chain olefins (of 8-25, preferably 12-21 carbon atoms) of the formula $RCH{=}CHR_1$, where R is alkyl and $R_1$ is alkyl or hydrogen, to produce a mixture of sultones and alkenesulfonic acids, which mixture is then treated to convert the sultones to sulfonates. Especially good characteristics are obtained by the use of a feedstock containing a major proportion, i.e., above 70 percent and preferably at 90 percent, of $\alpha$-olefins. Examples of such products are $C_{14}$ $\alpha$-olefin sulfonate, $c_{16}$ $\alpha$-olefin sulfonate, etc. Examples of other sulfate or sulfonate detergents are paraffin sulfonates, such as the reaction products of alpha olefins and bisulfites (e.g., sodium bisulfite), e.g., primary paraffin sulfonates of about 10–20, preferably about 15–20 carbon atoms; e.g., sodium n-pentadecane sulfonate, sodium n-octadecyl sulfonate sulfates of higher alcohols; salts of $\alpha$-sulfofatty esters (e.g., of about 10–20 carbon atoms, such as methyl $\alpha$-sulfomyristate or $\alpha$-sulfotallowate).

Examples of sulfates of higher alcohols are sodium lauryl sulfate, sodium tallow alcohol sulfate; Turkey Red Oil or other sulfated oils, or sulfates of mono- or di-glycerides of fatty acids (e.g., stearic monoglyceride monosulfate), alkyl poly (ethenoxy) ether sulfates such as the sulfates of the condensation products of ethylene oxide and lauryl alcohol (e.g., with 1–20 ethenoxy groups per molecule); lauryl or other higher alkyl glyceryl ether sulfonates; aromatic poly (ethenoxy) ether sulfates such as the sulfates of the condensation products of ethylene oxide and nonyl phenol (e.g., having 1–10 oxyethylene groups per molecule and usually from 2–10 such groups).

The suitable anionic detergents include also the acyl sarcosinates (e.g., sodium lauroylsarcosinate), the acyl esters (e.g., oleic acid ester) of isothionates, and the acyl N-methyl taurides (e.g., potassium N-methyl lauroyl- or oleyl tauride). In each instance, the acyl moieties usually vary from fatty $C_{10}$ to $C_{20}$ to preferably $C_{12}$ to $C_{16}$.

The most highly preferred water-soluble anionic detergent compounds are the ammonium and substituted ammonium (such as mono, di-, and triethanolamine), alkali metal (such as sodium and potassium) and alkaline earth metal (such as calcium and magnesium) salts of the higher alkyl benzene sulfonates, olefin sulfonates, the higher alkyl sulfates, and the higher fatty acid monoglyceride sulfates. The particular salt will be suitably selected depending upon the particular formulation and the proportions therein. Mixtures of various cations can also be used.

Non-ionic surface-active agents include those surface-active or detergent compounds which contain an organic hydrophobic group and a hydrophilic group which is a reaction product of a solubilizing group such as carboxylate, hydroxyl, amido or amino with an alkylene oxide, e.g., ethylene oxide, or with the polyhydration product thereof, e.g., polyethylene glycol.

As examples of such non-ionic surface-active agents, there may be noted the condensation products of alkyl phenols with ethylene oxide, e.g., the reaction product of isooctyl phenol with about 6–30 ethylene oxide units; condensation products of alkyl thiophenols with 10–15 ethylene oxide units; condensation products of higher fatty alcohols such as tridecyl alcohol with ethylene oxide; ethylene oxide addends of monoesters of hexahydric alcohols and inner ethers thereof such as sorbitan monolaurate, sorbitol mono-oleate and mannitan monopalmitate, and the condensation products of polypropylene glycol with ethylene oxide.

Cationic surface-active agents may also be employed. Such agents are those surface-active detergent compounds which contain an organic hydrophobic group and a cationic solubilizing group. Typical cationic solubilizing groups are amine and quaternary groups.

As examples of suitable synthetic cationic detergents, there may be noted the diamines such as those of the type $RNHC_2H_4NH_2$, wherein R is an alkyl group of about 12–22 carbon atoms, such as N-2-aminoethyl stearyl amine and N-2-aminoethyl myristyl amine; amide-linked amines such as those of the type $R^1CONHC_2H_4NH_2$ wherein $R^1$ is an alkyl group of about 9–20 carbon atoms, such as N-2-amino ethyl-stearyl amide and N-amino ethyl myristyl amide; quaternary ammonium compounds wherein typically one of the groups linked to the nitrogen atom is an alkyl group of about 12–18 carbon atoms and three of the groups linked to the nitrogen atom are alkyl groups which contain 1–3 carbon atoms, including such 1–3 carbon alkyl groups bearing inert substituents, such as phenyl groups, and there is present an anion such as halogen, acetate, methosulfate, etc. Typical quaternary ammonium detergents are ethyl-dimethyl-stearyl ammonium chloride, benzyl-dimethyl-stearyl ammonium chloride, benzyl-dimethyl-stearyl ammonium chloride, trimethyl-stearyl ammonium chloride, trimethylcetyl ammonium bromide, dimethyl-ethyl-dilauryl ammonium chloride, dimethyl-propyl-myristyl ammonium chloride, and the corresponding methosulfates and acetates.

Examples of suitable amphoteric detergents are those containing both an anionic and a cationic group and a hydrophobic organic group, which is advantageously higher aliphatic radical, e.g., of 10–20 carbon atoms. Among these are the N-long chain alkyl aminocarboxylic acids (e.g., of the formula

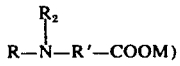

the N-long chain alkyl iminodicarboxylic acids (e.g., of the formula $RN(R'COOM)_2$) and the N-long chain alkyl betaines (e.g., of the formula

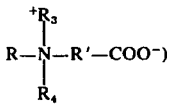

where R is a long chain alkyl group, e.g., of about 10–20 carbons, R′ is a divalent radical joining the amino and carboxyl portions of an amino acid (e.g., an alkylene radical of 1–4 carbon atoms), M is hydrogen or a salt-forming metal, $R^2$ is a hydrogen or another monovalent substituent (e.g., methyl or other lower alkyl), and $R^3$ and $R^4$ are monovalent substituents joined to the nitrogen by carbon-to-nitrogen bonds (e.g., methyl or other lower alkyl substituents). Examples of specific amphoteric detergents are N-alkyl-beta-aminopropionic acid; N-alkyl-beta-iminodipropionic acid, and N-alkyl, N, N-dimethyl glycine; the alkyl group may be, for example, that derived from coco fatty alcohol, lauryl alcohol, myristyl alcohol (or a laurylmyristyl mixture), hydrogenated tallow alcohol, cetyl, stearyl, or blends of such alcohols. The substituted aminopropionic and iminodipropionic acids are often supplied in the sodium or other salt forms, which may likewise be used in the practice of this invention. Examples of other amphoteric detergents are the fatty imidazolines such as those made by reacting a long chain fatty acid (e.g., of 10–20 carbon atoms) with diethylene triamine and monohalocarboxylic acids having 2–6 carbon atoms, e.g., 1-coco-5-hydroxy-ethyl-5-carboxymethyl-imidazoline; betaines containing a sulfonic group instead of the carboxylic group; betaines in which the long chain substituent is joined to the carboxylic group without an intervening nitrogen atom, e.g., inner salts of 2-tri-methylamino fatty acids such as 2-trimethylaminolauric acid, and compounds of any of the previously mentioned types, but in which the nitrogen atom is replaced by phosphorus.

Water-soluble builder salts may also be present, in the usual proportions, in the detergent formulations when heavy duty cleaning is desired. These salts include phosphates, and particularly condensed phosphates (e.g., pyrophosphates or tripolyphosphates), silicates, borates and carbonates (including bicarbonates), as well as organic builders such as salts of nitrilotriacetic acid or ethylene diamine tetracetic acid. Sodium and potassium salts are preferred, although alkaline earth metals, amine, alkylolamine and ammonium are contemplated. Specific examples are sodium tripolyphosphate, potassium pyrophosphate, sodium hexametaphosphate, sodium carbonate, sodium bicarbonate, sodium sesquicarbonate, sodium tetraborate, sodium silicate, salts (e.g., Na salt) of methylene diphosphonic acid, trisodium nitrilotriacetate, or mixtures of such builders, including mixtures of pentasodium tripolyphosphate and trisodium nitrilotriacetate in a ratio, of these two builders, of 1:10 to 10:1, e.g., 1:1. The proportions of builder salt may be, for example, 50 parts or more (e.g., 50 to 1000 parts) per 100 parts of detergent.

In "built" detergents, the organic cleaning agent, i.e., the anionic, non-ionic, etc. compound, may comprise from about 5 percent to upwards of 75 percent by weight of the total formulation, and usually varies from 5–35 percent by weight. In liquid compositions, the amount of water used is relatively high in order to obtain pourable and generally stable systems. In these liquids, total solids may vary from a few percent, i.e., 2–10 percent, upwards of about 60 percent with the organic detergent present, usually in amounts from about 2–25 percent, and preferably 5–15 percent. In solid formulations, i.e., powders, etc., total solids may run as high as 90 percent or more, and here the organic detergent may be used at the high concentrations above indicated but usually the range is 5–25 percent. The second major component of the built or heavy duty liquids, and this is true of the solid (i.e., powdered or tabletted types) formulations also, is the alkaline builder salt, and the amount thereof again may vary considerably, e.g., from 5–75 percent of the total composition. In the solid formulations, larger percentages are generally employed, e.g., 15–50 percent, whereas in the liquid types the salts are used in lesser amounts, e.g., 5–25 percent by weight of the total composition.

In any of the contemplated systems, the amount of softener will be governed primarily by economic considerations, since as pointed out above as little as 1 percent thereof, based on the total detergent formulation used, gives noticeable and marked softening effects. It is, of course, understood that to obtain a significant degree of softening based on the above figures, one is expected to employ the detergent composition in its usual amount which, based on the wash water, is about 0.15 percent, and based on the "load" is about 2.5 percent. From these figures, it is evident that significant softening is obtained where the softener is used at extremely low concentrations, e.g., 0.02 percent by weight based on the clothing load and in the neighborhood of 0.001 percent when calculated on the basis of the treating bath, e.g., wash water or the like.

In view of the wide latitude in the concentrations of the components of detergent compositions, a useful and operative range of detergent to softener is 40:1 to 1:10, preferably 15:1 to 1:2 and most preferred is a range of 5:1 to 1:1.

In formulating the aqueous, liquid, pourable compositions of this invention, it is desirable to have present adjuvants for improving if necessary and/or desired the homogeneity and pourability (i.e., viscosity) thereof. Particularly useful are the non-detergent alkali metal benzene sulfonates, such as sodium toluene sulfonate, sodium xylene sulfonate and sodium cumene sulfonate, and water-soluble alcohols, preferably saturated, aliphatic, monohydric alcohols such as ethanol and isopropanol. Such additives are especially advantageous in heavy duty formulations containing large amounts of builder salts. These compounds may be used singly or in admixture and in amounts from about 1 percent to about 20 percent by weight based on the total weight of the aqueous composition.

The following examples will serve to illustrate the present invention without being deemed limitative thereof. Parts are by weight, unless otherwise indicated.

EXAMPLE 16

A composition of the following is formulated:

2 g Linear Tridecyl Benzene Sulfonate (LTBS)
1 g 1-Dodecyl-3-(3′ aminopropyl) urea
6.6 g Sodium Tripolyphosphate.

The above is added to a terrycloth towel in a mini-wash attachment to a washing machine during the wash cycle using tap water (about 100 ppm hardness) at 120°F and carried through the normal sequence of spin, rinse, and spin cycles. After air-drying the towels are rated as to softness on a scale of 1 to 10. A rating of 1 corresponds to the results obtained with sulfonate and phosphate alone, and such a rating indicates that the towels are quite harsh. A rating of 10 is considered excellent insofar as softness and fluffiness are concerned. A rating of at least 5 is considered necessary for adequate softening performance. Ratings of 8 to 10 are notably and outstandingly soft. In the instant example, the towel is rated as having a softness of 10. Superior detergency was noted by the brightness of the towels, with no evidence of yellowing. The brightness can be measured in terms of *b* value, the higher +*b* value being indicative of greater yellowing and less brightness. The LTBS per se gives a *b* value of +1.6.

The concentration of the above formulation in the wash waer is about 0.09 percent by weight based on the weight of water present during the wash cycle.

EXAMPLE 17

Example 16 is repeated, but the reaction product of octadecyl isocyanate with isopropyldiamine is substituted for the 1-Dodecyl-3-(3′ aminopropyl) urea. The washed towel has a softness rating of 7, is bright, and exhibits no yellowing,

EXAMPLE 18

Example 16 is repeated, except that the reaction product of octadecylisocyanate with propyldiamine is substituted for the urea derivative therein. The washed towel has a softness rating of 4, which is indicative of some softness, although not as good as in the previous examples.

EXAMPLE 19

Example 16 is repeated except that $(C_{16}H_{33}—C_{18}H_{37})NHCONH(CH_2)_2NH_2$ is substituted for the urea derivative therein. The dried towel is rated 10+ on the softness scale, which is indicative of superior softness and has a *b* value of +2.2, which is indicative of no yellowing.

EXAMPLE 20

Example 16 is repeated except that 1-butyl-3-(12′ aminododecyl) urea, the product of Example 3, is substituted for the urea derivative of Example 16. The dried towel is rated 6 on the softness scale and +1.7 on the *b* scale.

EXAMPLE 21

Example 16 is repeated except that the product of Example 5 is substituted for the urea derivative of Example 16. Softness rating of towel is 5 and +1.7 on the *b* scale.

EXAMPLE 22

Example 16 is repeated except that the product of Example 4 is substituted for the urea derivative of Example 16. Softness rating of towel is 5 and +2.2 on the *b* scale.

EXAMPLE 23

Example 16 is repeated except that an equal weight of the following anionic detergents are used in place of the linear tridecyl benzene sulfonate:

A. sodium lauryl sulfate
B. sodium alkenyl sulfonate ($C_{15}$—20 percent; $C_{16}$—29 percent; $C_{17}$—28 percent; $C_{18}$—14 percent; $C_{19}$—1 percent)
C. sodium m-tetradecane sulfonate
D. ammonium alkenyl sulfonate ($C_{16}$ alkenyl)
E. sodium dodecyl benzene sulfonate.

EXAMPLE 24

A heavy duty powdered detergent is formulated containing:

| | |
|---|---|
| sodium linear tridecyl benzene sulfonate | 10 g |
| pentasodium tripolyphosphates | 33 |
| $C_{14-15}$ primary alcohol + 11 moles of ethylene oxide condensate (non-ionic detergent) | 2 |
| sodium silicate ($Na_2O:S:O_2$=1:2.35) | 7.5 |
| 1-octadecyl-3-(2′ aminomethyl) urea | 5 |
| sodium soap (83% tallow, 17% coco) | 2 |

-continued

| | |
|---|---|
| optical brighteners, sodium sulfate, water | QS |

In a terry cloth towel test in an automatic washing machine using tap water (hardness=100 ppm) at 120°F and at a concentration of 0.15 percent in the wash water, the results are towels exhibiting a 5 on the softness scale and +2.6 on the *b* scale. Softening performance decreased in a mixed anionic-nonionic surfactant system.

EXAMPLE 25

Softening composition:

| | % |
|---|---|
| $C_{16-18}H_{37}NHCONH(CH_2)_2NH_2$ | 5.0 |
| Isopropyl alcohol | 25.0 |
| Calcofluor CSL brightener solu (23% A.I.) | 2.3 (0.5% A.I.) |
| Polar Brilliant Blue, 1% solution | 1.5 |
| Water | 66.2 |

The urea softener powder is dispersed in alcohol, using heat to achieve a smooth white paste. Water is added slowly, followed by the brightener and the colorant. The resultant product is opaque, light blue, and readily pourable at room temperature.

100 grams of the above softening composition is added to the rinse cycle during the laundering of fabrics. The wet towels were extremely soft and the line-dried towels were rated $10^{++++}$. In addition, the whiteness rating on $-b$ scale, where the higher $-b$ value is indicative of greater whiteness, is −5.8, as compared to a rating of −5.7 for the detergent-washed towels not treated with a softener. The softness rating for said detergentwashed towels is 1.

Other suitable carriers and/or dispersants may be substituted for the aqueous-alcohol solution.

EXAMPLE 26

The softener composition of Example 25 is added to the wash cycle, together with the detergent composition. The wet towels are very soft, and the dried towels are rated 10 on the softness scale and −6.6 on the $-b$ whiteness scale.

EXAMPLE 27

| | % |
|---|---|
| LTBS | 10.0 |
| 1(3′-aminopropyl)-3-dodecyl urea | 5.0 |
| sodium tripolyphosphate | 35.0 |
| sodium hypochlorite (available chlorine) | 5.15 |
| water | QS |

Instant new softener and detergent-softener compositions can be packaged in paper, plastic, or any other suitable packing medium. For example, a water-soluble plastic material such as polyvinyl alcohol as a premeasured packet for dissolution in the washing machine may constitute the packaging medium. Another means of packaging may be in a pressurized metal, plastic, or glass container equipped with a propellant for use in the dryer, rather than in the washing machine. The instant formulations can be solid, such as free-flowing powders, chips, flakes, granules, tablets, soap bars; or in the form of a liquid solution or dispersion in water or other suitable medium.

It is understood that the foregoing detailed description is merely given by way of illustration and that many variations may be made therein without departing from the spirit of the invention.

What is claimed:

1. A bleach-stable, cleaning and fabric-softening composition comprising from 2 to 75 percent by weight of a detergent selected from the group consisting of anionic, nonionic, cationic, ampholytic and zwitterionic detergents, and an effective amount of from about 1 percent to about 20 percent based on the weight of said detergent of a softening agent selected from the group consisting of urea, diurea, thiourea, dithiourea, and mixtures thereof, represented by the formulae:

1. $RNHCXNH(CH_2)_nNH_2$, and
2. $RNHCXNH(CH_2)_nNHCXNHR$, wherein R is an alkyl group containing 2–18 carbons or an aryl group, X is oxygen or sulfur, and *n* is 2 to 12.

2. A composition in accordance with claim 1, wherein the organic detergent is anionic.

3. A composition in accordance with claim 1, wherein the softener is 1-dodecyl-3-(3′ aminopropyl) urea.

4. A composition in accordance with claim 1, wherein the softener is 1-octadecyl-3-(3′ aminoethyl) urea.

5. A composition in accordance with claim 1, wherein the softener is a mixture of 1-octadecyl-3-(3′ aminopropyl) urea and diurea.

6. A composition in accordance with claim 1, which contains a builder salt.

7. A composition in accordance with claim 1, wherein the ratio of detergent to softener is about 15:1 to 1:2.

8. A composition in accordance with claim 1, which contains a bleaching agent capable of liberating hypohalite ions.

9. A composition in accordance with claim 8, wherein the bleaching agent liberates chlorine.

10. An aqueous-alcohol bleach-stable, fabric-softening composition consisting essentially of an effective amount from about 1 percent to about 20 percent by weight of the formulation of a softening agent selected from the group consisting of urea, diurea, thiourea, dithiourea, and mixtures thereof, represented by the formulae:

1. $RNHCXNH(CH_2)_nNH_2$, and
2. $RNHCXNH(CH_2)_nNHCXNHR$, wherein R is an alkyl group containing 2–18 carbons or an aryl group, X is oxygen or sulfur, and *n* is 2 to 12.

11. A composition in accordance with claim 10, wherein the softener is 1-dodecyl-3-(3′ aminopropyl) urea.

12. A composition in accordance with claim 10, wherein the softener is 1-octadecyl-3-(3′ aminoethyl) urea.

13. A composition in accordance with claim 10, wherein the softener is a mixture of 1-octadecyl-3-(3′ aminopropyl) urea and diurea.

14. A method of softening and laundering textiles, which comprises adding to the wash cycle bath of the laundering process an amount sufficient to soften and launder textiles of the composition of claim 1.

15. A method as defined in claim 14, wherein the softener is present in the bath in a minimum amount of 0.001 percent by weight based on the weight of the bath.

16. A method of softening textiles in a laundry operation including at least a wash cycle and a rinse cycle, which comprises adding to the wash cycle or the rinse cycle bath a softening effective amount of a softening agent selected from the group consisting of urea, diurea, thiourea, dithiourea, and mixtures thereof, represented by the formulae:

1. $RNHCXNH(CH_2)_nNH_2$, and
2. $RNHCXNH(CH_2)_nNHCXNHR$, wherein R is an alkyl group containing 2–18 carbons or an aryl group, X is oxygen or sulfur, and *n* is 2 to 12.

17. A method in accordance with claim 16, wherein the softener is present in the bath in a minimum amount of 0.001 percent by weight of the bath.

* * * * *